United States Patent [19]

Sciarra

[11] Patent Number: 4,842,282

[45] Date of Patent: Jun. 27, 1989

[54] METHOD FOR PLAYING A TRIANGULAR PYRAMID BOARD GAME

[76] Inventor: Michael Sciarra, P. O. Box 71923, Los Angeles, Calif. 90071-0923

[21] Appl. No.: 27,242

[22] Filed: Mar. 18, 1987

[51] Int. Cl.[4] ..... A63F 3/02

[52] U.S. Cl. ..... 273/258

[58] Field of Search ..... 273/258, 260, 261, 248, 273/242

[56] References Cited

U.S. PATENT DOCUMENTS

| | | | |
|---|---|---|---|
| 1,211,748 | 1/1917 | O'Conner | 273/258 |
| 1,509,678 | 9/1924 | MacPherson et al. | 273/258 |
| 2,614,842 | 10/1952 | Rice | 273/258 |
| 4,005,866 | 2/1977 | Marcil | 273/260 |

FOREIGN PATENT DOCUMENTS

| | | | |
|---|---|---|---|
| 8824 | 2/1896 | United Kingdom | 273/258 |

OTHER PUBLICATIONS

Salta, The Way to Play, by The Diagram Group, p. 41, 1975.

*Primary Examiner*—Richard C. Pinkham
*Assistant Examiner*—Benjamin Layno
*Attorney, Agent, or Firm*—Milton S. Gerstein

[57] ABSTRACT

A board game in which the board has a playing surface formed into squares arranged into rows and columns, the end portions of which define the territory of the two players. Each territory has a plurality of consecutively numbered squares, arranged in a triangle, which constitute the array by which similarly-numbered playing pieces must be arranged in order to win the game. Each player's playing pieces are arranged in a starting array in his territory, and he must move his pieces toward the other player's territory and arrange his pieces in the opposing player's triangular array of numbered squares, with like-numbered pieces being positioned in like-numbered squares. Diagonal moves are not allowed, but sideways, rearward, and forward moves are allowed, as well as jumping of opposing pieces as long as an empty square is directly next to the opposing piece in the direction of the jump.

5 Claims, 1 Drawing Sheet

METHOD FOR PLAYING A TRIANGULAR PYRAMID BOARD GAME

BACKGROUND OF THE INVENTION

The present invention is directed to a board game having disks or chips thereon for movement along squares formed on the game board in order to rearrange the chips in a specified manner which constitutes the final aim of the game in order to win. Many board games with chips are known in which the chips or disks are moved along squares on the game board, the best known being checkers. However, none of the prior art games have rules according to that of the present invention, nor the goals thereof.

SUMMARY OF THE INVENTION

It is, therefore, the primary objective of the present invention to provide a game having a checkered board with chips or disks for movement along the squares of the checkered board, which chips or disks are arranged along the checkered board in an initial manner and which chips or disks are numbered consecutively.

It is also the objective of the present invention to have as the main goal of the present invention the rearrangement of the consecutively numbered chips in four rows on the other side of the game board from which the chips were positioned at the start of the game, the final configuration of the chips, by which the game is to be won, resembling a pyramid made up of four rows of chips.

BRIEF DESCRIPTION OF THE DRAWING

The invention will be more readily understood with reference to the accompanying drawings, wherein.

DETAILED DESCRIPTION OF THE INVENTION

Figure 1:
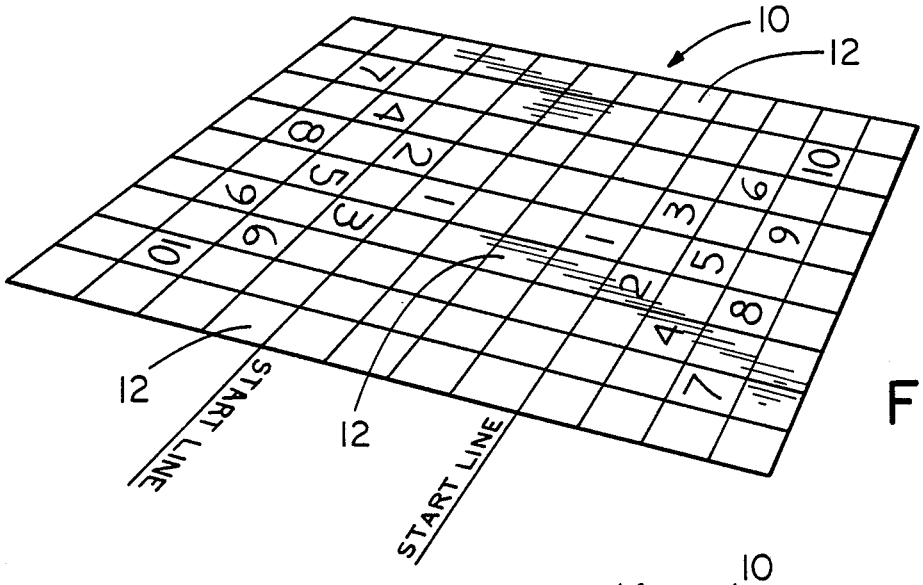
FIG. 1 is a pictorial view of the game board of the present invention.
Figure 2:
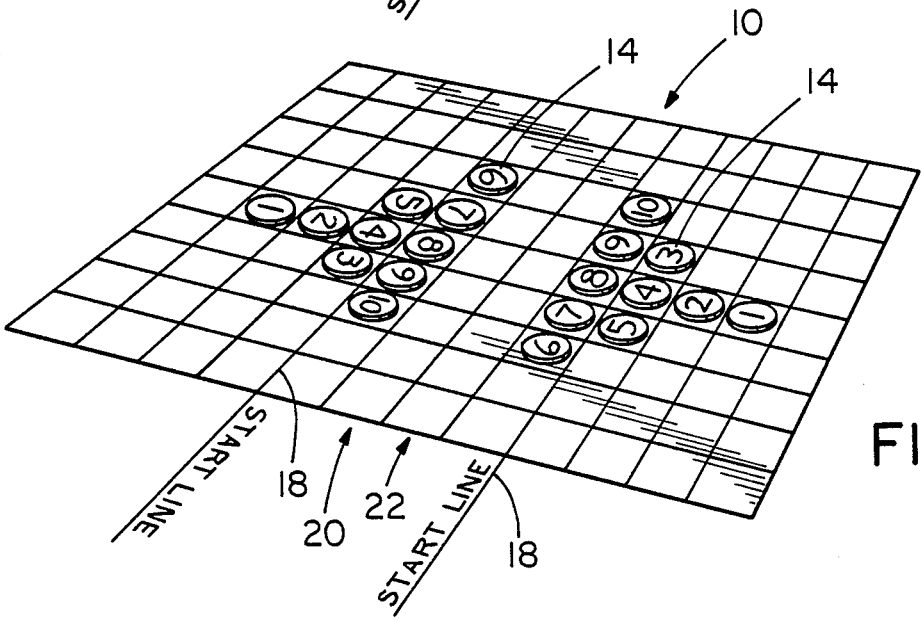
FIG. 2 is a pictorial view of the game board of the present invention with the pair of consecutively numbered disks positioned on the squares of the game board at the start of the game.
Figure 3:
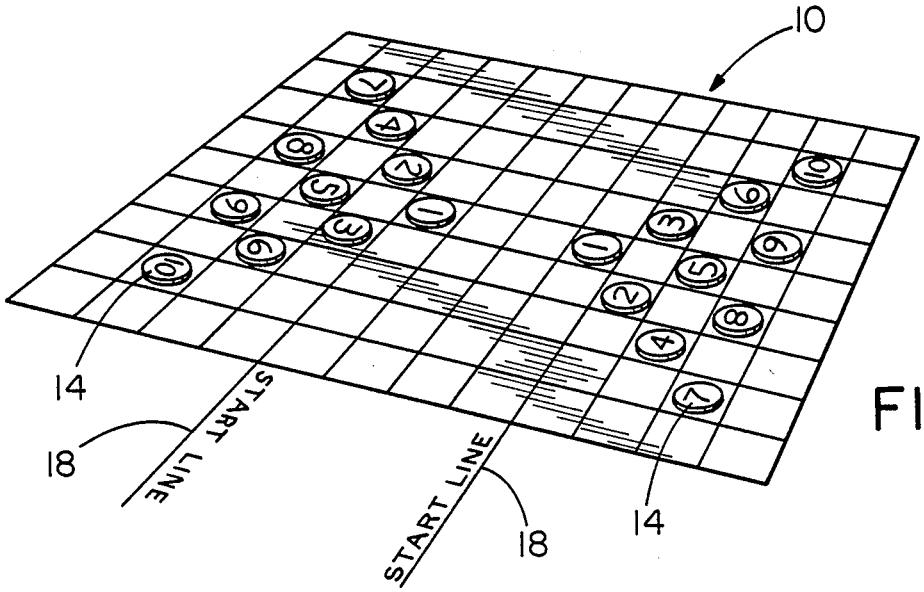
FIG. 3 is a pictorial view of the game board of the present invention with the pair of consecutively numbered disks thereon in the game winning position and constituting the winning arrangement.

Referring now to the drawings in greater detail, the game board of the present invention is shown in FIG. 1, and is indicated by reference numeral 10. The game board 10 is a flat piece, having an upper surface divided into a plurality of squares 12, which squares are arranged in rows and columns. Preferably, according to the preferred embodiment of the invention, there are provided nine columns and twelve rows of squares. As can be clearly seen in FIG. 1, some of the squares 12 are numbered consecutively from one to ten on each side of the board. Half of the board is to be the territory of one of the players, while the other half of the board is to be the territory of the other player. The arrangement of the consecutively numbered squares one through ten, resembles a pyramid or triangle, the pattern of which constitutes the game winning position of the chips to be attained. Referring to FIG. 2, there are shown a plurality of chips 14. In the preferred embodiment, there are two sets of ten such chips 14, each player having his own set, one preferably being white and one preferably being black. FIG. 2 shows the initial arrangement of each player's set of chips, with each set of chips being numbered consecutively from one to ten. In the starting position for each player, the chips are arranged as shown clearly in FIG. 2, with the chip number 1 lying in the second row from the end of the first player's territory in the middle column thereof, with the second chip number 2 lying directly forward thereof. Chips 3, 4 and 5 are arranged in a third row with the chip number 4 lying juxtaposed the chip number 2. The last and fourth row of the set of chips, chips 6, 7, 8, 9 and 10, are arranged such that the middle chip 8 is juxtaposed the middle chip 4 of the third row. It is noted that the board includes a start line 18 which is used initially to help orient the chips on the board in their starting positions in order to locate where the fourth row having chips 6 through 10 thereon are to be located. In the embodiment shown in FIG. 2, each player has a beginning territory of five rows, with two middle rows 20 and 22 being neutral territory. It is the object of the game, in order to win it, to have each player move his chips 14 on to the other side of the board in an arrangement indicated by the numbered squares shown in FIG. 1. That is to say, when viewing FIG. 2, the player whose chips 14 are shown on the left side of the board when viewing FIG. 2, are moved on to the right side of the board when viewing FIG. 2, in an arrangement such that the numbered chips thereof lie in the numbered squares on the right side of the board, wins the game. FIG. 3 clearly shows the chips arranged in their final, game winning orientation.

In accordance with the rules of the game, each of the chips of each player may be moved one square at a time in alternative sequence, with each chip being able to be moved in a forward direction, which forward direction is taken toward the opponent's side of the board, in a sideways direction, and in a rearward direction. Diagonal movement is not permitted. Furthermore, jumping of an opponent's piece is possible, as long as the piece being jumped has an adjacent square that is vacant. Therefore, only one chip may be jumped at a time, although multiple jumps may be permitted as long as there is a vacant space between chips. Furthermore, only the opponent's chips may be jumped, and not one's own. As can be clearly seen by comparing FIGS. 3 and 2, the object is to rearrange the four starting rows of the players chips into four finished rows such that the chip numbered one lies on the other side of the start line 18 compared to the remainder of the chips in their finished arrangement, which finished arrangement includes four rows of chips the first row having one chip, the second row having two chips, the third row having three chips, and the fourth row having four chips, with a space between each chip, in comparison to the initial set up arrangement of the chips, in which there are two rows of one chip each, followed by a third row of three chips, and a fourth row of five chips, to thereby convert the initial arrangement into a triangular pyramid, as clearly shown in FIG. 3. Thus, there are not only different amounts of pieces in each of the rows in the finished arrangement as compared to the initial arrangement, but there must be a continued consecutive arrangement of these numbered pieces. While backward movement is possible, it is possible to include in the rules the fact that no backward movement is allowable for any of the players' pieces behind his start line 18. Also, as stated above, diagonal movements are definitly not permissible. Thus, not only is it the objective of each player to move his pieces forward, and arrange them in a triangular pyramid, in consecutive order, but is also the object of each player to prevent his opponent from moving his or her pieces forwardly, and to prevent such forward movement in a manner that would allow consecutive numbering of the opponent's pieces in a triangular pyramid, in the configuration shown in FIG. 3. Thus, defensive employment of the pieces is necessary, with selective movements being aimed to prevent the movement of consecutively numbered pieces of the opponent in a manner that would best allow him to arrange them consecutively in triangular pyramidal arrangement on the other side of the board.

It is preferable that the number of rows exceed the number of columns, and it is also preferable that the number of columns provided be at least four more than the number of playing pieces contained in the row having the most playing pieces positioned therein at the start of the game thereof. This ensures that there are at least two columns of unoccupied squares on either side of the row containing playing pieces six through ten, not only to allow for adequate playing room for maneuvering the playing pieces in order to position them on the opponent's end of the playing surface, but also to allow for the repositioning of the playing pieces after they have been moved to the opponent's end of the playing surface. As can be seen in FIG. 3, in each of the rows having playing pieces, these playing pieces are spaced apart so that an empty square lies on either side of each playing piece. The provision of at least one column of empty squares on either side of the last row having the greatest number of playing pieces at the game-winning state allows for enhanced maneuvaribility of the pieces to arrange them in the game-winning order.

While a specific embodiment of the invention has been shown and described, it is to be understood that numerous changes and modifications may be made therein without departing from the scope, spirit and intent of the invention as set forth in the appended claims.

What is claimed is:

1. In a method of playing a board game, which game board has a playing surface divided into a plurality of squares arranged into rows and columns, and for which are provided two sets of a plurality of consecutively numbered playing pieces for movement along the squares of the playing surface, the playing surface being divided into a first player's territory at one end portion thereof, a second player's territory at the other end portion thereof, and a middle portion serving as a neutral territory, said method comprising:

arranging said sets of playing pieces on the playing surface such that each set is positioned in a respective player's territory, said step of arranging comprising positioning each player's playing pieces in consecutive order into a plurality of rows with the playing piece numbered one lying in a center square of a row farther away from the middle portion of the playing surface than the other rows in which are positioned other ones of the playing pieces, positioning the second numbered playing piece in the center square of the row next-closest to the middle portion, positioning the third, fourth and fifth numbered playing pieces in the row next closest to the middle portion such that the fourth numbered playing piece lies in the same column as the first and second numbered playing pieces, and positioning the sixth, seventh, eighth, ninth and tenth numbered playing pieces in the row next closest to the middle portion of the playing surface such that the eighth numbered playing piece lies in the same column as the first, second and fourth numbered playing pieces;

alternatively moving a playing piece of the first set and a playing piece of the second set, said step of moving comprising moving one respective piece in one of the forward, backward, and sideways directions; and rearranging each set of playing pieces in consecutive order on the other player's territory which defines the game-winning state; said step of rearranging comprising positioning the first numbered piece in a first row of the other player's territory on the center square thereof, positioning the second and third numbered playing pieces in a second row farther away from the middle portion than the first row containing the first-numbered playing piece, positioning the fourth, fifth and sixth numbered playing pieces in a third row farther away from the middle portion than the second row, and positioning the seventh, eighth, ninth and tenth playing pieces in a fourth row still farther away from the middle portion than the third row to form a triangular array, such that the first, second, fourth and tenth playing pieces lie along a diagonal, and the first, third, sixth and tenth numbered playing pieces lie along a different diagonal to thus form the two sides of the triangular array.

2. The method according to claim 1, wherein said step of arranging further comprises positioning the playing pieces in their respective rows such that the playing pieces in each row lie directly adjacent to each other on directly adjacent squares of the respective row.

3. The method according to claim 1 wherein said step of rearranging comprises positioning the fifth numbered playing piece in the same column as the first numbered playing piece, positioning the third and ninth numbered playing pieces in the same column, and positioning the second and eighth numbered playing pieces in the same column.

4. The method according to claim 3, wherein said step of rearranging further comprises spacing each playing piece from a playing piece in the same row such that at least one free square lies on either side of the respective playing piece.

5. The method according to claim 4, wherein said step of rearranging comprising positioning the playing pieces in four directly adjacent rows.

* * * * *